US010794589B2

(12) United States Patent
Shershnyov et al.

(10) Patent No.: US 10,794,589 B2
(45) Date of Patent: Oct. 6, 2020

(54) LIQUID FUEL CARTRIDGE FOR A FUEL NOZZLE

(71) Applicant: General Electric Company, Schenectady, NY (US)

(72) Inventors: Borys Borysovich Shershnyov, Moscow (RU); Alexey Yurievich Gerasimov, Moscow (RU)

(73) Assignee: General Electric Company, Schenectady, NY (US)

( * ) Notice: Subject to any disclaimer, the term of this patent is extended or adjusted under 35 U.S.C. 154(b) by 908 days.

(21) Appl. No.: 15/325,856

(22) PCT Filed: Nov. 8, 2013

(86) PCT No.: PCT/RU2013/000998
§ 371 (c)(1),
(2) Date: Jan. 12, 2017

(87) PCT Pub. No.: WO2015/069131
PCT Pub. Date: May 14, 2015

(65) Prior Publication Data

US 2017/0176000 A1 Jun. 22, 2017

(51) Int. Cl.
*F23D 11/10* (2006.01)
*F23D 11/16* (2006.01)
(Continued)

(52) U.S. Cl.
CPC ..... *F23D 11/10* (2013.01); *F23D 11/106* (2013.01); *F23D 11/16* (2013.01); *F23D 11/38* (2013.01);
(Continued)

(58) Field of Classification Search
CPC ..... F23D 11/10; F23D 11/102; F23D 11/103; F23D 11/12; F23D 11/16; F23R 3/28; F23R 3/286; F23R 3/30
See application file for complete search history.

(56) References Cited

U.S. PATENT DOCUMENTS 6,378,787 B1 * 4/2002 Buchi ..... F23D 11/26 239/406
2009/0211256 A1 * 8/2009 Williams ..... F02C 7/222 60/739
(Continued)

FOREIGN PATENT DOCUMENTS

CN 201344532 Y 11/2009
JP S61-242624 A 10/1986
(Continued)

OTHER PUBLICATIONS

Machine translation and Notification of Reasons for Refusal issued in connection with corresponding JP Application No. 2016-527249 dated Aug. 29, 2017.
(Continued)

*Primary Examiner* — Todd E Manahan
*Assistant Examiner* — Katheryn A Malatek
(74) *Attorney, Agent, or Firm* — Nixon & Vanderhye P.C.

(57) ABSTRACT

A liquid fuel cartridge for a gas turbine fuel nozzle includes a tube having an inlet end and an outlet end with one or more fuel exit orifices; and a homogenizer located within the tube, adjacent and up-stream of the outlet end. The homogenizer is formed by a substantially-cylindrical body open at opposite ends, and a first row of circumferentially-spaced flanges projecting radially outwardly from the substantially cylindrical body, with radially-outer edges of said flanges engaged with an interior surface of the tube thereby creating a plurality of apertures for a liquid fuel and water emulsion. The homogenizer body may also be provided with a plural-
(Continued)

ity of circumferentially-spaced radially-oriented orifices to promote better mixing of the fuel/water emulsion.

20 Claims, 8 Drawing Sheets

(51) Int. Cl.
*F23D 11/38* (2006.01)
*F23R 3/28* (2006.01)
*F23R 3/30* (2006.01)

(52) U.S. Cl.
CPC ..... *F23R 3/28* (2013.01); *F23R 3/286* (2013.01); *F23D 11/102* (2013.01); *F23D 11/103* (2013.01); *F23R 3/30* (2013.01)

(56) References Cited

U.S. PATENT DOCUMENTS

2009/0255262 A1* 10/2009 McMasters ..... F23R 3/14 60/742
2010/0275604 A1* 11/2010 Hall ..... F23D 11/103 60/748
2011/0005230 A1* 1/2011 Bailey ..... F02C 7/22 60/738
2012/0291447 A1 11/2012 Boardman et al.
2013/0186094 A1 7/2013 Parsania et al.

FOREIGN PATENT DOCUMENTS

JP H11-159757 A 6/1999
JP 2010-138797 A 6/2010
JP 2012-132672 A 7/2012
WO 2007/061055 A2 5/2007
WO WO-2007061055 A2 * 5/2007 ..... F23D 11/36
WO 2011/052416 A1 5/2011
WO 2013/115671 A1 8/2013

OTHER PUBLICATIONS

First Office Action and Search issued in connection with corresponding CN Application No. 201380080821.4 dated Apr. 5, 2017.
International Search Reported dated Jul. 8, 2014, two pages.

* cited by examiner

LIQUID FUEL CARTRIDGE FOR A FUEL NOZZLE

RELATED APPLICATION

This application is the U.S. national phase of International Application PCT/RU2013/000998 filed Nov. 8, 2013 which designated the U.S., the entire content of this application is incorporated by reference.

BACKGROUND OF THE INVENTION

The invention relates to fuel combustion in a gas turbine, and particularly to fuel nozzles for a Dry Low NOx (DLN) combustor.

A gas turbine combustor mixes large quantities of fuel and compressed air, burns the resulting mixture and generates combustion gases to drive a turbine. Conventional combustors for industrial gas turbines typically include an annular array of cylindrical combustion "cans" in which air and fuel are mixed and combustion occurs. Compressed air from a compressor, e.g., an axial compressor, flows into the combustor, and fuel is injected through fuel nozzle assemblies that extend into each can.

A DLN system developed by the assignee utilizes a two-stage premixed combustor designed for use with natural gas fuel and capable of operating with liquid fuel. In a conventional, exemplary configuration, six primary fuel nozzles surround a center fuel nozzle in each of an annular array of combustors. Briefly, one exemplary DLN combustion system operates in four distinct modes:

1. Primary—Fuel to the primary nozzles only. Flame is in the primary stage only. This mode of operation is used to ignite, accelerate and operate the machine over low-to mid-loads, up to a pre-selected combustion reference temperature.

2. Lean-Lean—Fuel to both the primary and secondary nozzles. Flame is in both the primary and secondary stages. This mode of operation is used for intermediate loads between two pre-selected combustion reference temperatures.

3. Secondary—Fuel to the secondary nozzle only. Flame is in the secondary zone only. This mode is a transition state between lean-lean and premix modes. This mode is necessary to extinguish the flame in the primary zone, before fuel is reintroduced into what becomes the primary premixing zone.

4. Premix—Fuel to both primary and secondary nozzles. Flame is in the secondary stage only. This mode of operation is achieved at and near the combustion reference temperature design point. Optimum emissions are generated in premix mode.

It will be appreciated that both the primary and secondary nozzles can be dual-fuel nozzles, allowing automatic transfer from gas to oil throughout the load range. With regard to the secondary or center nozzle, when operating on liquid fuel, the fuel is supplied to the center nozzle as a mixture (mixed externally of the combustor) of fuel and water. The fuel and water must be mixed well because a low-quality mixture may provide too much water and insufficient fuel or vice versa (or a non-uniform distribution of both throughout the supply stream), which has a negative impact on combustion, leading to higher NOx emissions. There is a need, therefore, to provide a mechanism by which a higher-quality emulsion of water and fuel is achieved before injection into the combustion chamber.

BRIEF SUMMARY OF THE INVENTION

In one exemplary but nonlimiting embodiment, a liquid fuel cartridge for a gas turbine fuel nozzle comprises a tube having an inlet end and an outlet end provided with one or more fuel exit orifices; and a homogenizer located within the tube, adjacent and upstream of the outlet end, the homogenizer formed by a substantially-cylindrical body open at opposite ends, with a first row of circumferentially-spaced flanges projecting radially outwardly from the substantially cylindrical body, and with radially-outer edges of the flanges engaged with an interior surface of the tube.

In another exemplary aspect the invention provides a liquid fuel cartridge for a gas turbine fuel nozzle comprising a tube having an inlet end and an outlet end with one or more fuel exit orifices; a homogenizer located within the tube, adjacent and upstream of the outlet end, the homogenizer formed by three adjacent but axially-spaced disks including a first upstream disk provided with a relatively-small center opening; a second intermediate disk provided with a relatively-large center opening; and a third downstream disk provided a center opening smaller than the first center and surrounded by a plurality of outer openings.

In still another aspect the invention a fuel nozzle for a gas turbine comprising a nozzle body configured to include annular, concentric fuel and air passages about a center centrally located liquid fuel cartridge; the liquid fuel cartridge comprising a tube having an inlet end and an outlet end with one or more fuel exit orifices; and a homogenizer located within the tube, adjacent and upstream of the outlet end, the homogenizer formed by a substantially-cylindrical body open at opposite ends, and a first row of circumferentially-spaced flanges projecting radially outwardly from the substantially cylindrical body with radially-outer edges of the flanges engaged with an inner surface of the tube.

The invention will now be described in more detail in connection with the drawings identified below.

DETAILED DESCRIPTION OF THE INVENTION

Figure 1:
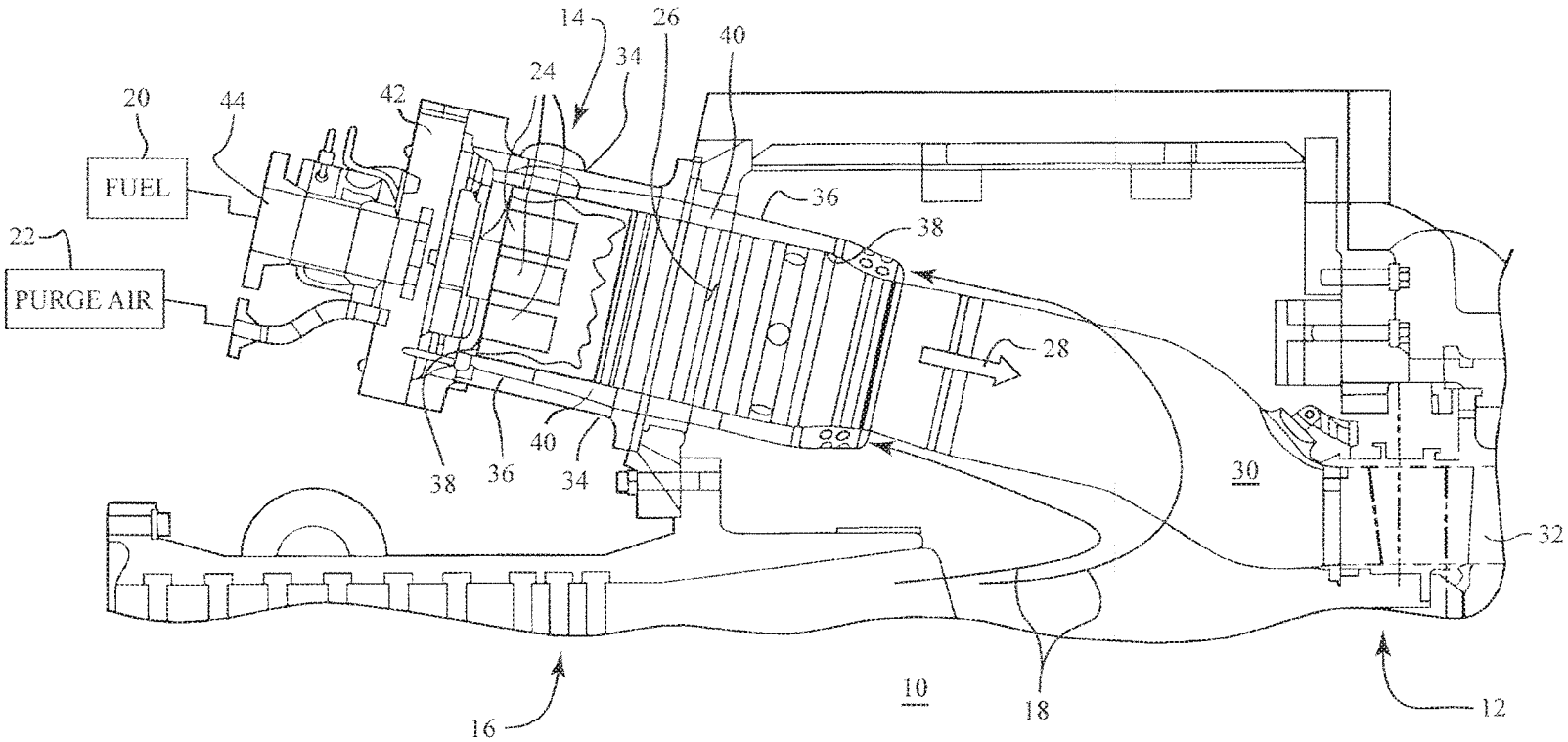
FIG. 1 (PRIOR ART)
FIG. 1 is a cross-sectional diagram of a conventional combustor in an industrial gas turbine.

FIG. 1 is side view, showing in partial cross section, a conventional turbine engine 10 including an axial turbine section 12, an annular array of combustors 14 (one shown), and an axial compressor 16. A working fluid 18, e.g., atmospheric air indicated by flow arrows, is pressurized by the compressor 16 and ducted to each of the combustors 14. An end of each combustor is coupled to manifolds which deliver liquid fuel 20 and a purge gas 22, e.g., atmospheric air under pressure, to the combustors. The fuel and purge gas flow through fuel nozzle assemblies 24, mix with the pressurized working fluid and combust in a combustion chamber 26 of each combustor. Combustion gases 28 flow from the combustion chamber through a duct or transition piece 30 between the combustion chamber and the turbine to drive buckets (blades) 32 supported on the turbine rotor. The rotation of the shaft drives the compressor 16 and transfers useful output power from the gas turbine to, for example, a generator.

Each combustor 14 has an outer cylindrical casing 34. Compressed air from the compressor, e.g., the working fluid 18, flows through an annular duct 40 in the combustor formed between a cylindrical flow sleeve 36 and a cylindrical combustion liner 38. The combustion chamber 26 is within the hollow liner of the combustor. The compressed air flows in a counter-current direction to the flow of combustion gases through the combustion zone and is supplied to the fuel nozzle assemblies 24 at the head end of the combustor.

A combustor end cover 42 supports a pipe branch 44 to manifolds (not shown) that provide the liquid fuel 20 and passive purge air 22 to each combustor. The end cover 42 also includes passages which direct the liquid fuel 20 and purge air 22 to the fuel nozzle assemblies 24.

Figure 2:
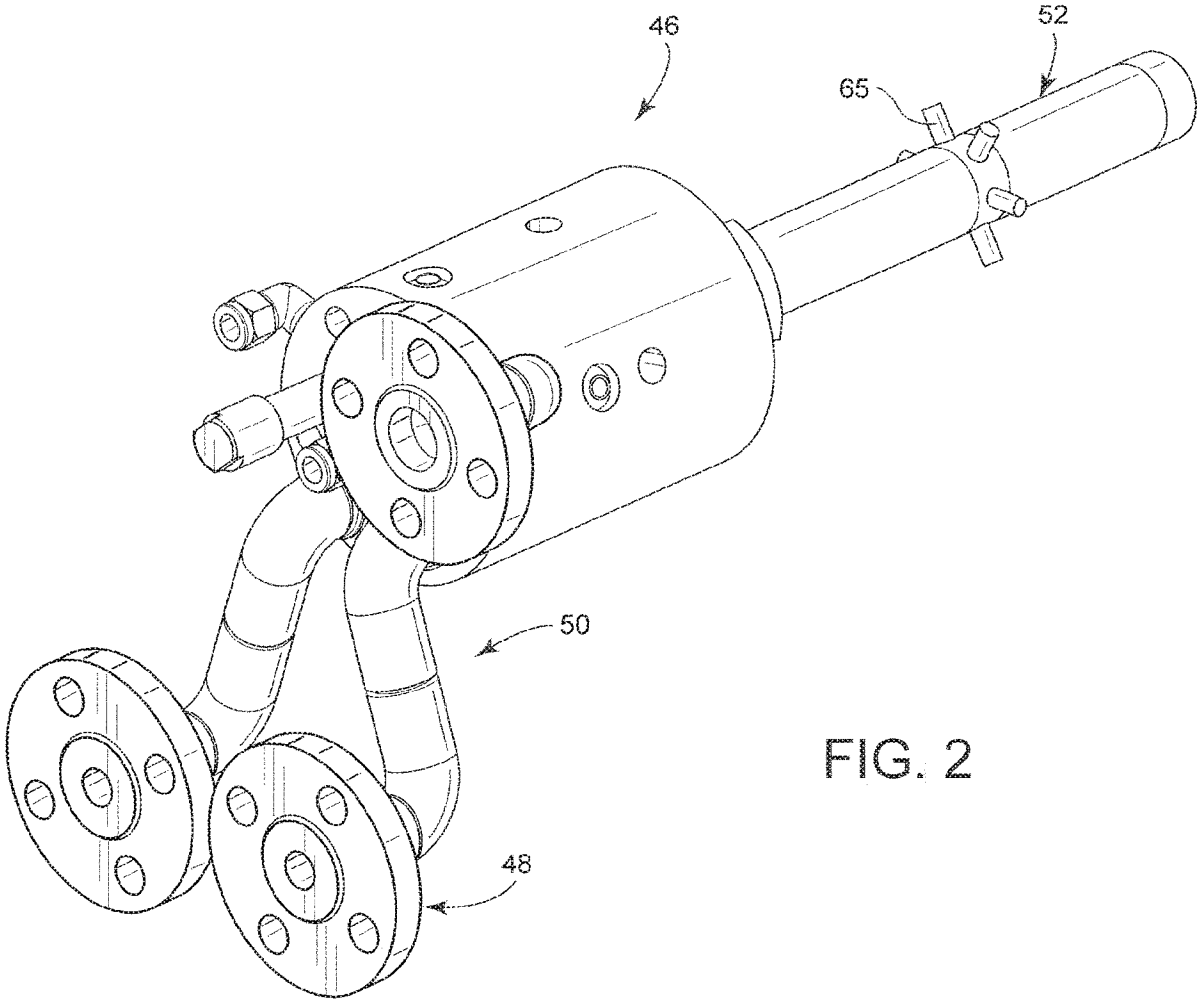
FIG. 2 is a perspective view of a fuel nozzle in accordance with an exemplary but nonlimiting embodiment of the invention.

FIG. 2 is a perspective view of a fuel nozzle assembly 46 in accordance with an exemplary but nonlimiting embodiment of the invention. The fuel nozzle is typically located in the center of a DLN combustor, surrounded by an annular array of primary nozzles (not shown, but of conventional construction), each mounted to the combustor end cover by conventional means and including flange 48 and piping 50 for supplying gas fuel and liquid fuel to the nozzle assemblies generally as described above.

Figure 3:
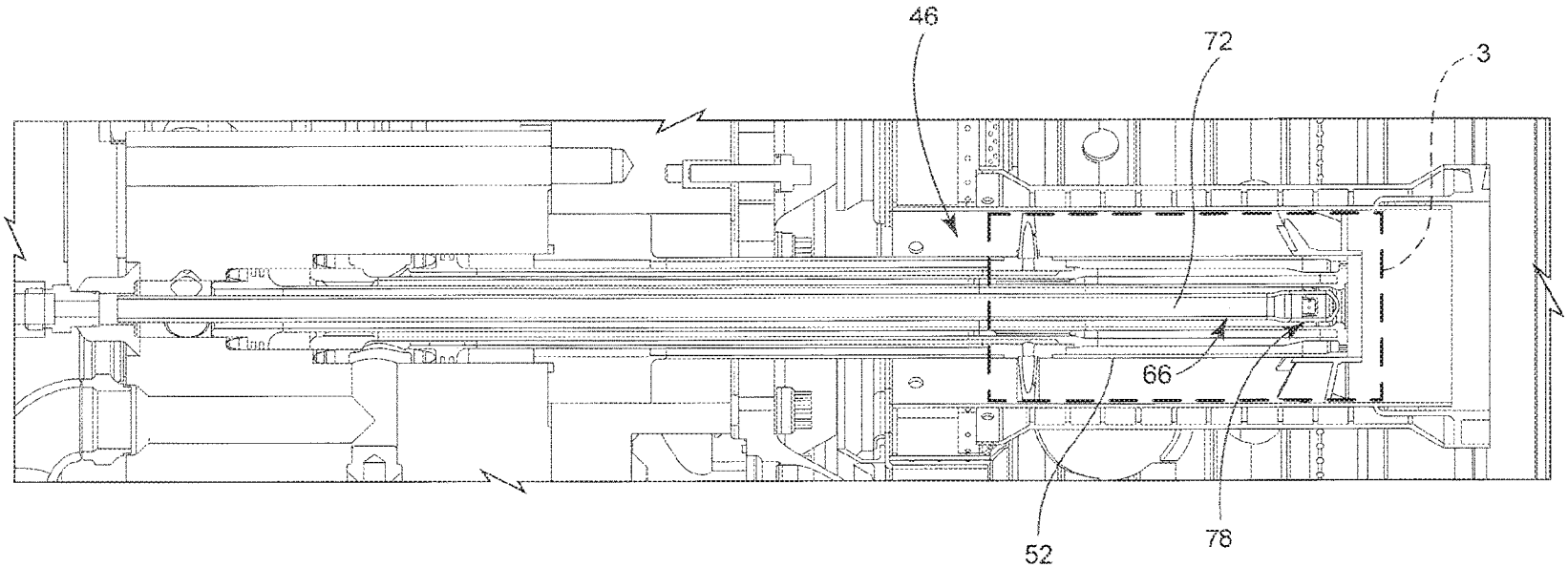
FIG. 3 is a partial cross-section of the fuel nozzle shown in FIG. 2.
Figure 4:
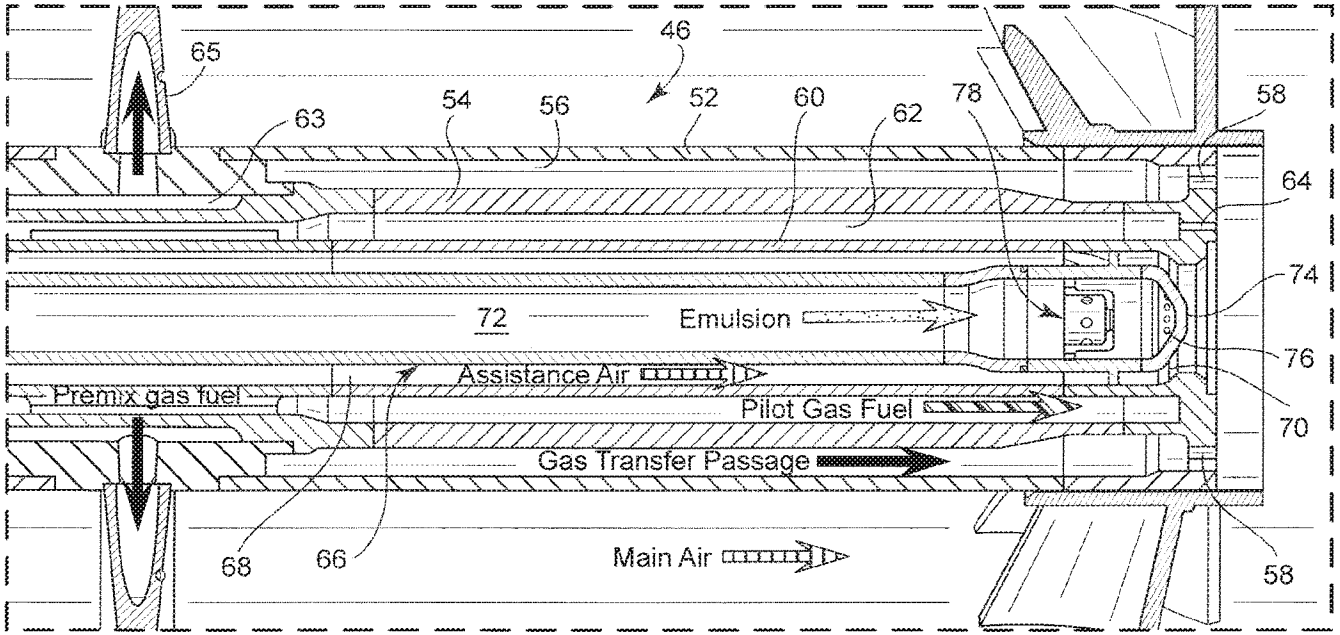
FIG. 4 is an enlarged detail of the downstream end of the fuel nozzle shown in FIG. 3.
Figure 5:
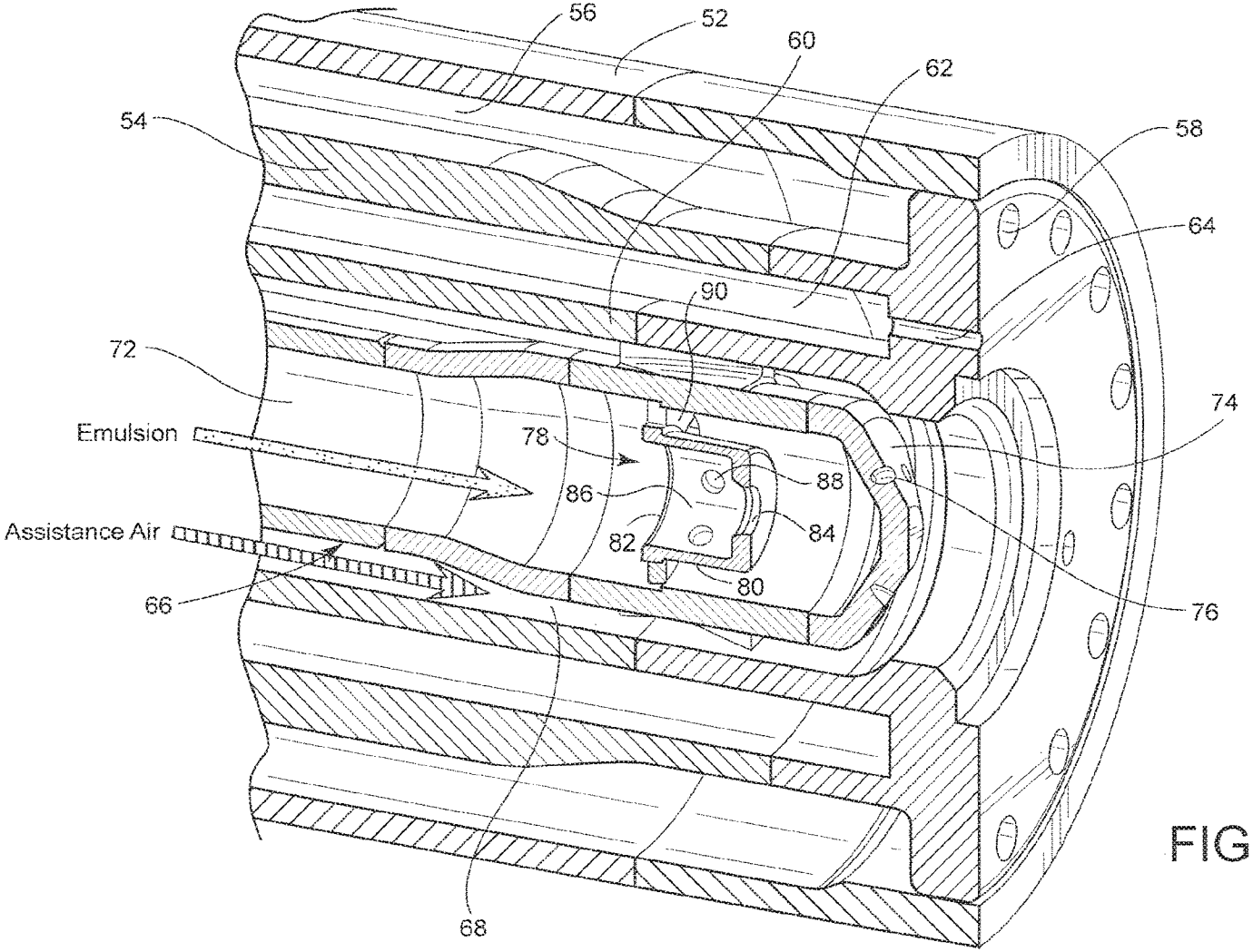
FIG. 5 is an enlarged, sectioned perspective view of the tip of the fuel nozzle shown in FIGS. 2 and 3, incorporating a homogenizer in accordance with the invention.

With particular reference to FIGS. 3-5, at the aft or downstream end of the fuel nozzle assembly 46, the configuration includes an outer sleeve or tube 52 and a first inner sleeve or tube 54 which define a gas transfer passage 56, with exit orifices 58 arranged in an annular array. The first inner sleeve or tube 54 and a second inner tube (radially inward of the first inner tube) 60 define a pilot gas fuel passage 62, with for example, plural exit orifices 64 (one shown), preferably spaced at 120° intervals. The nozzle is also provided with a premix fuel passage 63 with radially-oriented exit pegs 65 in accordance with conventional secondary fuel nozzles. This feature of the fuel nozzle forms no part of the present invention.

Centered within the fuel nozzle is a liquid fuel cartridge 66 which defines an assistance-air passage 68 radially between the cartridge 66 and the second inner tube 60. The assistance air exits the fuel nozzle at an annular exit opening 70. The liquid fuel cartridge 66 itself provides or forms the liquid fuel passage 72 having a closed end 74 but provided with an array of fuel exit orifices 76. Upstream of the exit orifices 76 there is a homogenizer 78 with features that cause the water/fuel mixture within the liquid fuel cartridge 66 to become homogenized before injection into the combustion chamber via the orifices 76.

Figure 6:
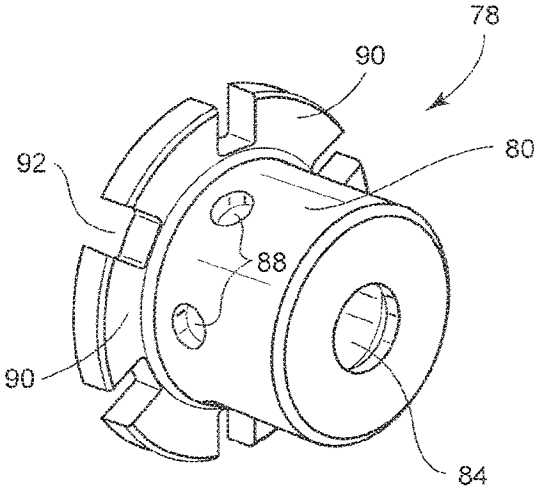
FIG. 6 is a perspective view of the homogenizer removed from the liquid fuel cartridge of the fuel nozzle shown in FIGS. 2-5.

FIGS. 5 and 6 illustrate details of this first exemplary homogenizer 78. Specifically, the axially-extending homogenizer body 80 is substantially cylindrical, with an open upstream end 82 and a downstream or inlet end having a relatively smaller hole or outlet 84 in its center, defining an axial passage 86. The axially-extending body 80 is provided with an array of orifices 88 arranged circumferentially about the body, thus providing radially-oriented exits for a portion of the fuel flowing axially in the passage 86.

At the upstream end of the body 80, there is a plurality of radially-extending, circumferentially-spaced flanges 90, thus forming circumferentially-spaced slots 92 between the flanges. When installed within the cartridge 66, the slots 92 are closed at their radially-outermost ends by the cartridge wall, thus creating a series of apertures through which the liquid fuel can flow in the axial direction. It will be appreciated that the water/fuel mixture flowing into the passage 86 of the liquid fuel cartridge 66 will be broken up into several streams extending both axially (via hole 84 and closed slots or apertures 92) and radially via orifices 88. The flow patterns created by this configuration of axial and radial passages provide for high-quality homogenization of the water/fuel mixture before the mixture is injected into the combustion chamber.

Figure 7:
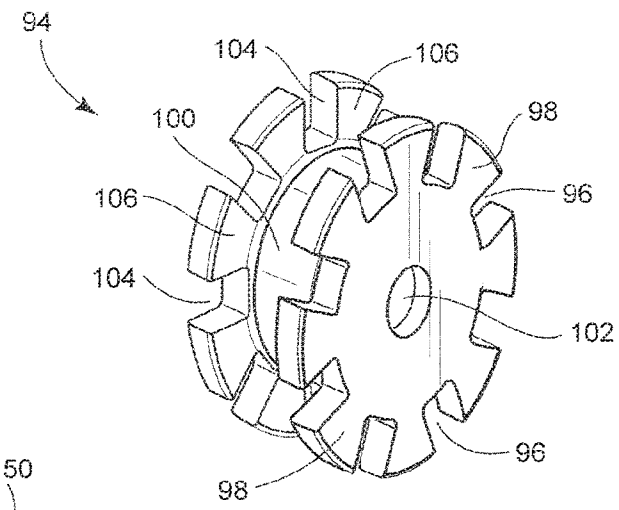
FIG. 7 is a perspective view of another homogenizer in accordance with the invention.

In the embodiment shown in FIG. 7, a similar homogenizer 94 is illustrated but, in this design, a second row of circumferentially-spaced, closed slots or apertures 96 are created by a second, grouping of circumferentially-spaced, radial flanges 98 at the downstream end of the body 100, radially adjacent the center hole 102. In this exemplary embodiment, the second row of closed slots 96 is circumferentially staggered with respect to a first row of closed slots 104 formed by spaced flanges 106 at the upstream end of the homogenizer body 100, thereby further enhancing the mixing action of the fuel and water. This embodiment may or may not have the radially-oriented holes or orifices 88 in the body, axially between the rows of slots of flanges 96, 98/104, 106.

Figure 8:
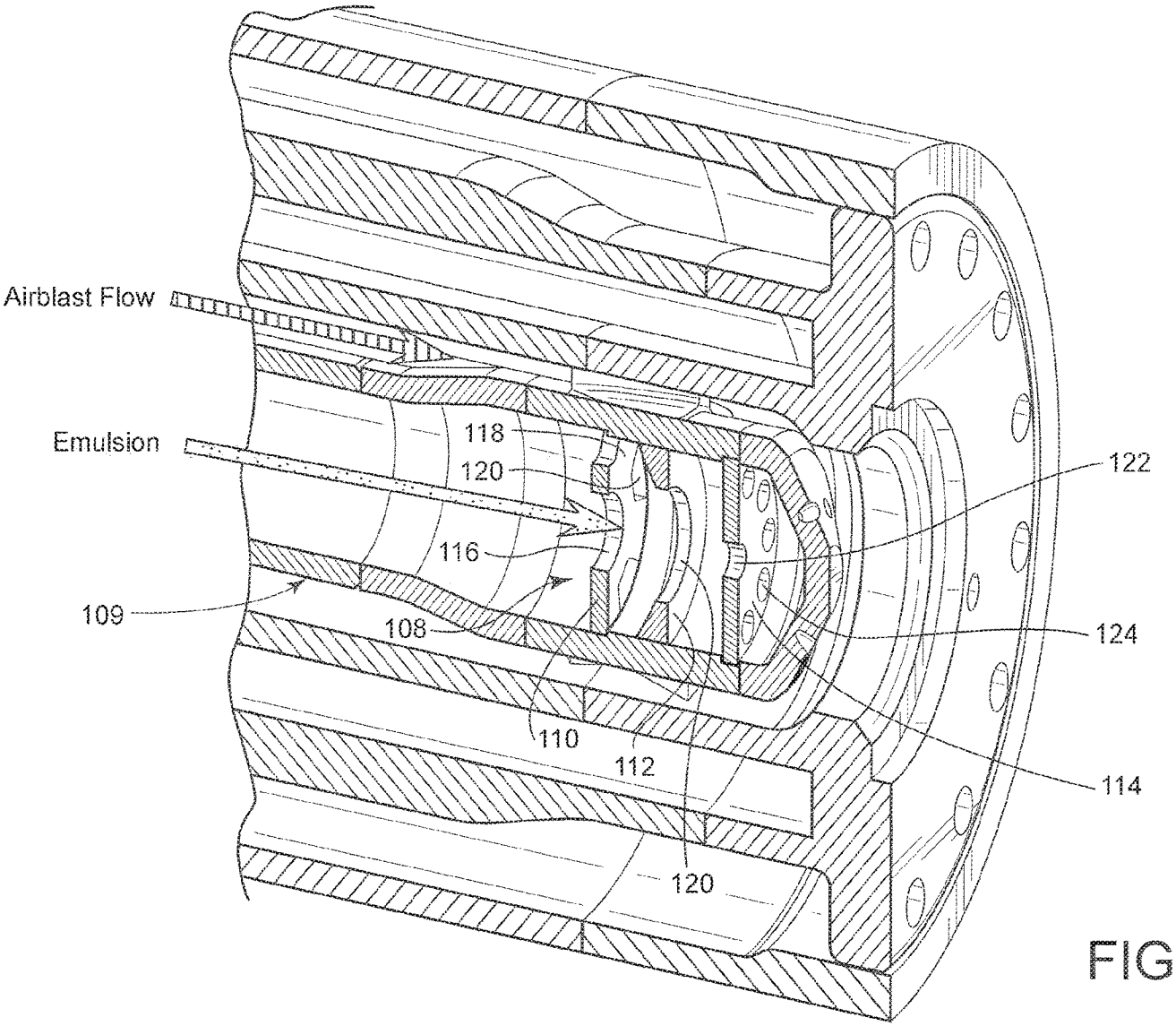
FIG. 8 is an enlarged, sectioned perspective view of the tip of the fuel nozzle shown in FIGS. 2 and 3, but with a third exemplary homogenizer.

FIG. 8 discloses a third homogenizer 108 in the liquid fuel cartridge 109 that is similar to the cartridge shown in FIGS. 2-5. Here, the homogenizer 108 is formed by three, axially-spaced disks 110, 112, 114, each engaging the interior wall of the downstream end of the liquid fuel cartridge 109. The upstream disk 110 is formed with a center hole 116 and circumferentially-spaced, radial flanges 118, creating axially-oriented slots 120 (similar to slots 92, 96). The intermediate disk 112 is formed with a center hole 120, larger than the center hole 116. The downstream disk 114 is formed with a small center hole 122 (smaller than center holes 116, 120), surrounded by a radially-outer array of circumferentially-spaced holes 124. This combination of holes and slots, combined with the expansion areas between the disks, creates enhanced homogenization of the water/fuel mixture before the mixture exits the liquid fuel cartridge and enters the combustion chamber.

Figure 10:
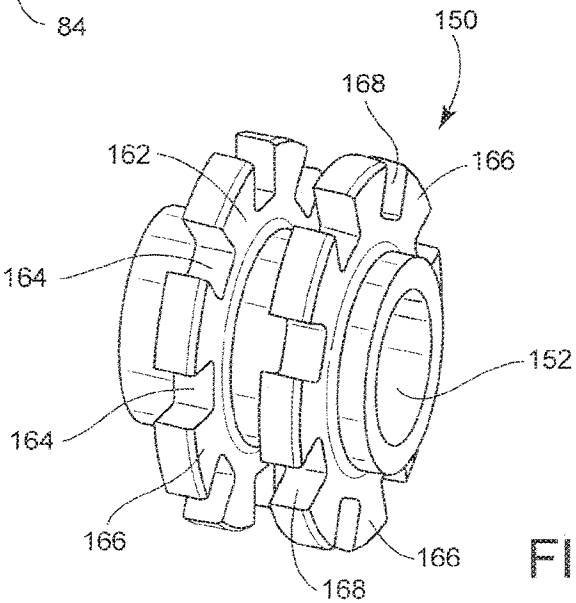
FIG. 10 is a perspective view of the homogenizer removed from the liquid fuel cartridge shown in FIG. 9.
Figure 9:
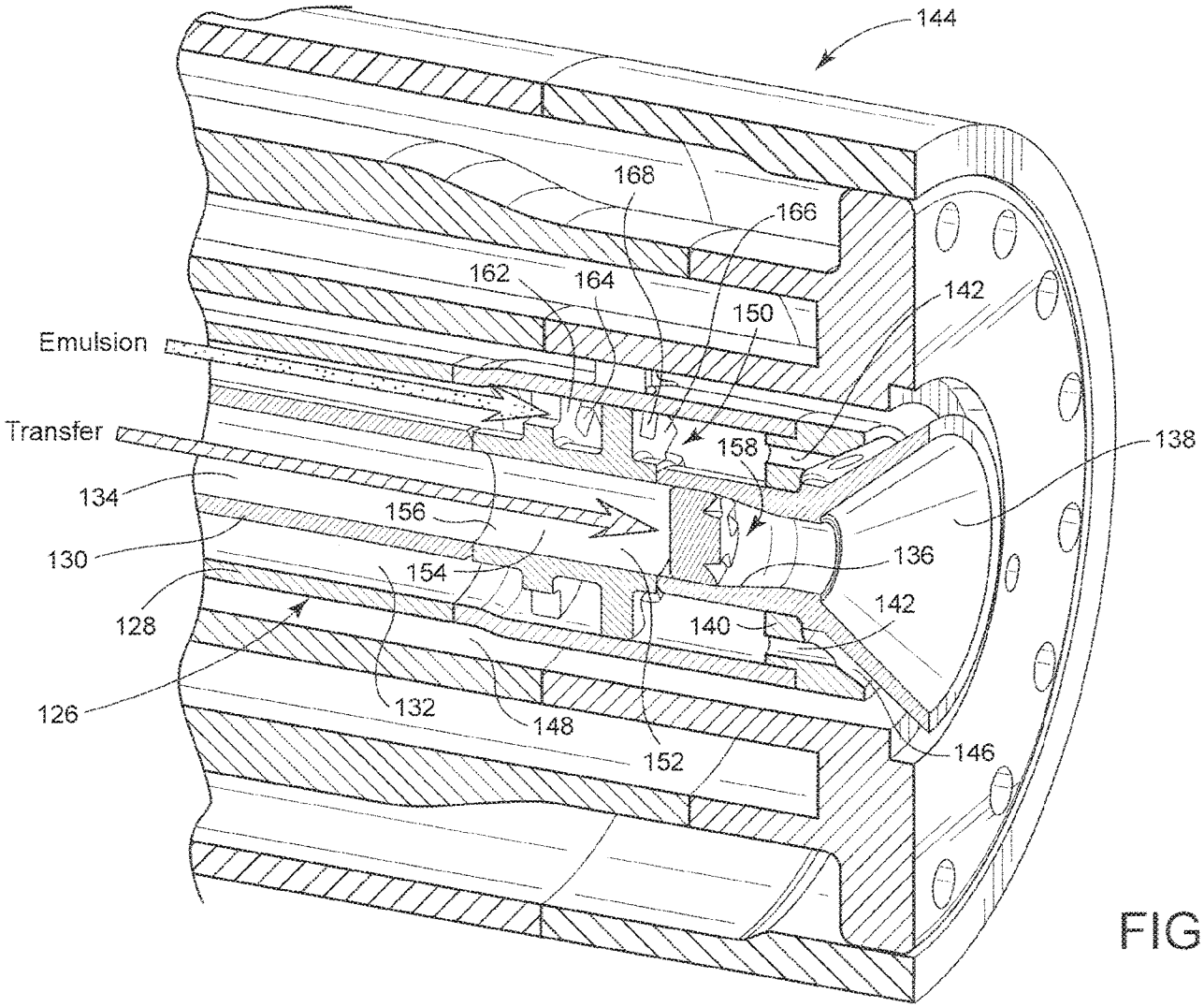
FIG. 9 is an enlarged detail of the tip of another fuel nozzle incorporating a fourth exemplary homogenizer.

FIGS. 9 and 10 illustrate another fuel nozzle 144 with a modified, centered liquid fuel cartridge. The nozzle 144 is similar to the nozzle 46 described above but with modifications to the liquid fuel cartridge centered within the nozzle. More specifically, the liquid fuel cartridge 126 comprises a pair of concentric tubes 128, 130 such that an emulsion or main fuel passage 132 is established in the radial space between the inner tube 130 and the outer tube 128. A transfer fuel passage 134 is defined by the inner tube 130 which narrows to form a throat region 136 and then expands through the outwardly tapered or flared exit end 138. The outer tube 128 is provided with an internal flange 140 that engages the inner tube 130 at the throat region 136, the flange 140 formed with an array of emulsion exit orifices 142 located such that the emulsion impinges upon the tapered exit end 138 of the inner tube 130 and exits the nozzle 144 via an annular air passage 146 between the outwardly flared end 138 of the second inner tube or sleeve 130 and the outer tube 128 of the liquid fuel cartridge 126. The emulsion mixes with the air in an airblast passage 148 surrounding the liquid fuel cartridge which assists in atomizing the emulsion as it exits the fuel nozzle. The airblast air provides additional air for combustion and mixing with the combustion gases. The airblast air passage 148 is concentric with the main fuel and transfer fuel passages 132, 134 in the liquid fuel cartridge, transporting fuel and purge air to the combustion zone.

A homogenizer 150 is fitted to the inner tube 130 upstream of the internal flange 140. The homogenizer 150 is similar to that shown in FIG. 7, with the exception that the downstream or outlet end 152 of the center passage 154 has a diameter substantially equal to the diameter of the inlet or upstream end 156, creating an unimpeded flow through the center of the homogenizer for the transfer fuel. The transfer fuel may also pass through a swirler 158 located between the homogenizer 150 and the throat region 136. The swirl assists in causing the fuel sprayed from the exit orifices 160 of the swirler to expand radially out from the centerline of the nozzle in a conical spray pattern permitted by the expanded or flared end 138 of the inner tube 130.

The double rows of staggered flanges/slots 162, 164 and 166, 168 serve to homogenize the main fuel in passage 132 before exiting via orifices 142.

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A liquid fuel cartridge for a gas turbine fuel nozzle comprising:

a tube having an inlet end and an outlet end provided with one or more fuel exit orifices, wherein the inlet end is coupled to a source of a mixture of liquid fuel and water;

a homogenizer located within said tube, adjacent and upstream of said outlet end, said homogenizer formed by a substantially cylindrical body open at opposite ends, with a first row of circumferentially-spaced flanges projecting radially outwardly from said substantially cylindrical body and slots between the circumferentially-spaced flanges, and with radially-outer edges of said flanges engaged with an interior surface of said tube, wherein a length of the homogenizer is less than a length of the tube, and a second row of circumferentially-spaced flanges projecting radially outwardly from said substantially cylindrical body with radially-outer edges of said second row of circumferentially spaced flanges engaged with said interior surface of said tube, and slots between the circumferentially-spaced flanges of the second row.

2. The liquid fuel cartridge of claim 1 wherein said substantially cylindrical body is provided with a row of circumferentially-spaced holes adjacent and downstream of said first row of circumferentially-spaced flanges.

3. The liquid fuel cartridge of claim 1, wherein the circumferentially-spaced flanges of said second row are staggered relative to the circumferentially-spaced flanges of said first row.

4. The liquid fuel cartridge of claim 1 wherein said opposite ends of said substantially cylindrical body include an inlet end and an outlet end, said outlet end of the substantially cylindrical body having a diameter smaller than a corresponding diameter of said inlet end of the substantially cylindrical body.

5. The liquid fuel cartridge of claim 2 wherein said opposite ends of said substantially cylindrical body include an inlet end and an outlet end, said outlet end of the substantially cylindrical body having a diameter smaller than a corresponding diameter of said inlet end of the substantially cylindrical body.

6. The liquid fuel cartridge of claim 2 wherein said opposite ends of said substantially cylindrical body have openings of substantially-identical diameters.

7. A liquid fuel cartridge for a gas turbine fuel nozzle in a combustor of a gas turbine, the liquid fuel cartridge comprising:

a tube having an inlet end and an outlet end with one or more fuel exit orifices, wherein the inlet end is coupled to at least one source of a mixture of liquid fuel and water, and the one or more fuel exit orifices face a combustion chamber of the combustor;

a homogenizer located within said tube, adjacent and upstream of said outlet end, said homogenizer formed by three adjacent and axially-spaced disks which include:

a first upstream disk provided with a first center opening;

a second intermediate disk provided with a second center opening; and a third downstream disk provided with a third center opening surrounded by a plurality of outer openings.

8. The liquid fuel cartridge of claim 7 wherein the first center opening is smaller than the second center opening.

9. The liquid fuel cartridge of claim 7 wherein the third center opening is smaller than at least one of the first center opening and the second center opening.

10. The liquid fuel cartridge of claim 7 wherein the third center opening and the plurality of outer openings are of substantially the same diameter.

11. A fuel nozzle for a combustor of a gas turbine comprising:

a nozzle body including annular, concentric fuel and air passages about a centrally located liquid fuel cartridge;

said centrally located liquid fuel cartridge comprising:

a tube having an inlet end and an outlet end with one or more fuel exit orifices, wherein the inlet end is coupled to at least one source of a mixture of liquid fuel and water, and the outlet end faces a combustion chamber of the combustor; and a homogenizer located within said tube, adjacent and upstream of said outlet end, said homogenizer formed by a substantially cylindrical body open at opposite ends, and a first row of circumferentially-spaced flanges projecting radially outwardly from said substantially cylindrical body with radially-outer edges of said flanges engaged with an inner surface of said tube and slots between the flanges and extending from the substantially cylindrical body to the inner surface of the tube, wherein a length of the homogenizer is less than a length of the tube.

12. The fuel nozzle of claim 11 further comprising:

a single liquid fuel passage defined by the inner surface of the tube, and an annular air passage surrounding the tube.

13. The fuel nozzle of claim 11 wherein said tube comprises a first center tube arranged to carry transfer fuel and a second tube radially spaced from said center tube and arranged to carry main fuel.

14. The fuel nozzle of claim 13 wherein said substantially cylindrical body is provided with a row of circumferentially-spaced holes adjacent and downstream of said first row of circumferentially-spaced flanges.

15. The fuel nozzle of claim 13 comprising a second row of circumferentially-spaced flanges projecting radially outwardly from said substantially cylindrical body with radially-outer edges of said flanges engaged with said inner surface of said tube, and slots between the circumferentially-spaced flanges of the second row.

16. The fuel nozzle of claim 15 wherein the circumferentially-spaced flanges of said second row are staggered relative to the circumferentially-spaced flanges of said first row.

17. The fuel nozzle of claim 16 wherein said opposite ends of said substantially cylindrical body include an inlet end and an outlet end, said outlet end of the substantially cylindrical body having a diameter smaller than a corresponding diameter of said inlet end of the substantially cylindrical body.

18. The fuel nozzle of claim 16, wherein said opposite ends of said substantially cylindrical body include an inlet end and an outlet end, said outlet end of the substantially cylindrical body having a diameter substantially identical to a corresponding diameter of said inlet end of the substantially cylindrical body.

19. The liquid fuel cartridge of claim 1, wherein each of the slots in the second row is aligned, along an axial direction of the tube, with a respective one of the circumferentially-spaced flanges of the first row.

20. The fuel nozzle of claim 15 wherein each of the slots in the second row is aligned, along an axial direction of the tube, with a respective one of the circumferentially-spaced flanges of the first row.

* * * * *